US010710370B2

(12) United States Patent
VanKouwenberg et al.

(10) Patent No.: US 10,710,370 B2
(45) Date of Patent: Jul. 14, 2020

(54) SYSTEM AND METHOD FOR ATTENUATING THE DRYING OF INK FROM A PRINTHEAD DURING PERIODS OF PRINTHEAD INACTIVITY

(71) Applicant: Xerox Corporation, Norwalk, CT (US)

(72) Inventors: David A. VanKouwenberg, Avon, NY (US); Linn C. Hoover, Webster, NY (US); Michael J. Levy, Webster, NY (US); Jason M. LeFevre, Penfield, NY (US); Chu-heng Liu, Penfield, NY (US); Paul J. McConville, Webster, NY (US); Douglas K. Herrmann, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 9 days.

(21) Appl. No.: 16/223,553

(22) Filed: Dec. 18, 2018

(65) Prior Publication Data

US 2020/0189281 A1 Jun. 18, 2020

(51) Int. Cl.
*B41J 2/165* (2006.01)
*B41J 2/175* (2006.01)

(52) U.S. Cl.
CPC ..... *B41J 2/16511* (2013.01); *B41J 2/16523* (2013.01); *B41J 2/16526* (2013.01); *B41J 2/17596* (2013.01)

(58) Field of Classification Search
CPC ..... B41J 2/16511; B41J 2/17596; B41J 2/16523; B41J 2/16526
See application file for complete search history.

(56) References Cited

U.S. PATENT DOCUMENTS 4,296,418 A 10/1981 Yamazaki et al.
4,364,065 A 12/1982 Yamamori et al.
(Continued)

FOREIGN PATENT DOCUMENTS

DE 10 2011 002 727 A1 7/2012
EP 1 827 839 B1 2/2009
(Continued)

OTHER PUBLICATIONS

Kwon et al.; Measurement of inkjet first-drop behavior using a high-speed camera; Review of Scientific Instruments; Mar. 2, 2016; vol. 87—Issue No. 3; AIP Publishing.

*Primary Examiner* — Bradley W Thies
(74) *Attorney, Agent, or Firm* — Maginot, Moore & Beck LLP

(57) ABSTRACT

An inkjet printer is configured with capping stations for storing printheads in the printer during periods of printer inactivity so the viscosity of the ink in the nozzles of the inkjets of the printheads does not increase significantly. Each capping station has a printhead receptacle that encloses a volume, a planar member configured to move between a first position at which the planar member is located within the printhead receptacle and a second position at which the planar member is external of the printhead receptacle, a first actuator operatively connected to the planar member, the first actuator being configured to move the planar member from the first position to the second position, and a controller configured to operate the first actuator to move the planar member from the first position to the second position to mate the planar member with a face of a printhead.

14 Claims, 8 Drawing Sheets

(56) References Cited

U.S. PATENT DOCUMENTS

| | | | | |
|---|---|---|---|---|
| 4,571,601 | A | 2/1986 | Teshima | |
| 4,746,938 | A | 5/1988 | Yamamori et al. | |
| 4,947,187 | A | 8/1990 | Iwagami | |
| 5,300,958 | A | 4/1994 | Burke et al. | |
| 5,394,178 | A | 2/1995 | Grange | |
| 5,412,411 | A | 5/1995 | Anderson | |
| 5,635,965 | A * | 6/1997 | Purwins | B41J 2/16511 347/31 |
| 5,663,751 | A | 9/1997 | Holbrook | |
| 5,936,647 | A | 8/1999 | Rhodes et al. | |
| 5,949,448 | A | 9/1999 | Man et al. | |
| 5,980,622 | A | 11/1999 | Byers | |
| 6,135,585 | A | 10/2000 | Johnson et al. | |
| 6,508,533 | B2 | 1/2003 | Tsujimoto et al. | |
| 6,578,947 | B1 | 6/2003 | Suwabe et al. | |
| 6,726,304 | B2 | 4/2004 | Fassler et al. | |
| 7,156,514 | B2 | 1/2007 | Rosa | |
| 7,753,475 | B2 | 7/2010 | Berry et al. | |
| 7,810,899 | B2 | 10/2010 | Usui et al. | |
| 7,992,986 | B2 | 8/2011 | Snyder et al. | |
| 8,592,503 | B2 | 11/2013 | Bogale et al. | |
| 2003/0231222 | A1 | 12/2003 | Jefferson et al. | |
| 2007/0252863 | A1 | 11/2007 | Sun et al. | |
| 2007/0263026 | A1 | 11/2007 | Shang et al. | |
| 2008/0018677 | A1 | 1/2008 | White et al. | |
| 2008/0024532 | A1 | 1/2008 | Kim | |
| 2008/0204501 | A1 | 8/2008 | Kurita et al. | |
| 2009/0237424 | A1 | 9/2009 | Martin et al. | |
| 2010/0073445 | A1 | 3/2010 | Silverbrook et al. | |
| 2012/0162311 | A1 | 6/2012 | Taira | |
| 2013/0215189 | A1 | 8/2013 | Justice et al. | |
| 2014/0253633 | A1 | 9/2014 | Kobayashi et al. | |
| 2018/0244048 | A1 | 8/2018 | Ito | |
| 2018/0311986 | A1 | 11/2018 | Moriyama | |

FOREIGN PATENT DOCUMENTS

| | | | |
|---|---|---|---|
| JP | 4937785 | B2 | 5/2012 |
| KR | 10-1397307 | B1 | 5/2014 |
| WO | 2008-026417 | A1 | 3/2008 |

* cited by examiner

SYSTEM AND METHOD FOR ATTENUATING THE DRYING OF INK FROM A PRINTHEAD DURING PERIODS OF PRINTHEAD INACTIVITY

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 7. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D, as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. In a prior art printer, a capping station, such as the station 60 shown in FIG. 8A, is used to cover a printhead when the printer is not in use. The cap is formed as a receptacle 704 to collect ink produced by the printhead 708 during a purge of the printhead. An actuator (not shown) is operated to move the printhead 708 into contact with an opening in the receptacle 704 as shown in FIG. 8B so the printhead can be purged to restore inkjets in the printhead by applying pressure to the ink manifold and passageways in the printhead. This pressure urges ink out of the nozzles in the faceplate of the printhead. This ink purging helps restore clogged and inoperative inkjets to their operational status. The ink purged from the printhead is directed to an exit chute 712 so the ink can reach a waste receptacle. The cap receptacle 704 also helps keep the ink in the nozzles from drying out because the printhead face is held within the enclosed space of the cap receptacle rather than being exposed to circulating ambient air.

For some quickly drying inks, however, the enclosed space of the cap is sufficient to enable the solvent, such as water, in the ink to evaporate from the ink. This evaporation occurs most quickly at the edges of the nozzles, which are located in the dashed circles in FIG. 9, since the ink is thinnest at these positions. As the viscosity of the ink increases from this evaporation, the ink begins to adhere to the bore of the nozzle 630 and the inkjets can become clogged. Although a purging operation can remove the high viscosity ink from the inkjets and bring fresh ink into the inkjets of the printhead, this purging operation can waste a lot of ink. Reducing the need for purging a printhead using quickly drying inks after a printhead is removed from a capping station would be beneficial.

SUMMARY

A method of inkjet printer operation enables ink at the nozzles of a printhead to maintain a low viscosity state. The method includes operating with a controller a first actuator operatively connected to a planar member to move the planar member from a first position where the planar member is within a printhead receptacle to a second position where the planar member is outside the printhead receptacle to mate the planar member with a face of a printhead, and operating with the controller a second actuator operatively connected to a printhead to move the printhead to a position where the planar member can mate with the printhead.

A capping station implements the method that enables ink at the nozzles of a printhead to maintain a low viscosity state. The capping station includes a printhead receptacle having at least one wall configured to enclose a volume, the printhead receptacle having an opening corresponding to a perimeter of a printhead, a planar member configured to move between a first position at which the planar member is located within the printhead receptacle and a second position at which the planar member is external of the printhead receptacle, a first actuator operatively connected to the planar member, the first actuator being configured to move the planar member from the first position to the second position, and a controller operatively connected to the first actuator. The controller is configured to operate the first actuator to move the planar member from the first position to the second position to mate the planar member with a face of a printhead.

An inkjet printer implements the method that enables ink at the nozzles of a printhead to maintain a low viscosity state. The printer includes a plurality of printheads and a capping station for each printhead in the plurality of printheads. Each capping station includes a printhead receptacle having at least one wall configured to enclose a volume, the printhead receptacle having an opening corresponding to a perimeter of a printhead, a planar member configured to move between a first position at which the planar member is located within the printhead receptacle and a second position at which the planar member is external of the printhead receptacle, a first actuator operatively connected to the planar member, the first actuator being configured to move the planar member from the first position to the second position, and a controller operatively connected to the first actuator. The controller is configured to operate the first actuator to move the planar member from the first position to the second position to mate the planar member with a face of a printhead.

BRIEF DESCRIPTION OF THE DRAWINGS

The foregoing aspects and other features of a system and method that enable ink at the nozzles of a printhead to maintain a low viscosity state are explained in the following description, taken in connection with the accompanying drawings.

DETAILED DESCRIPTION

Figure 1:
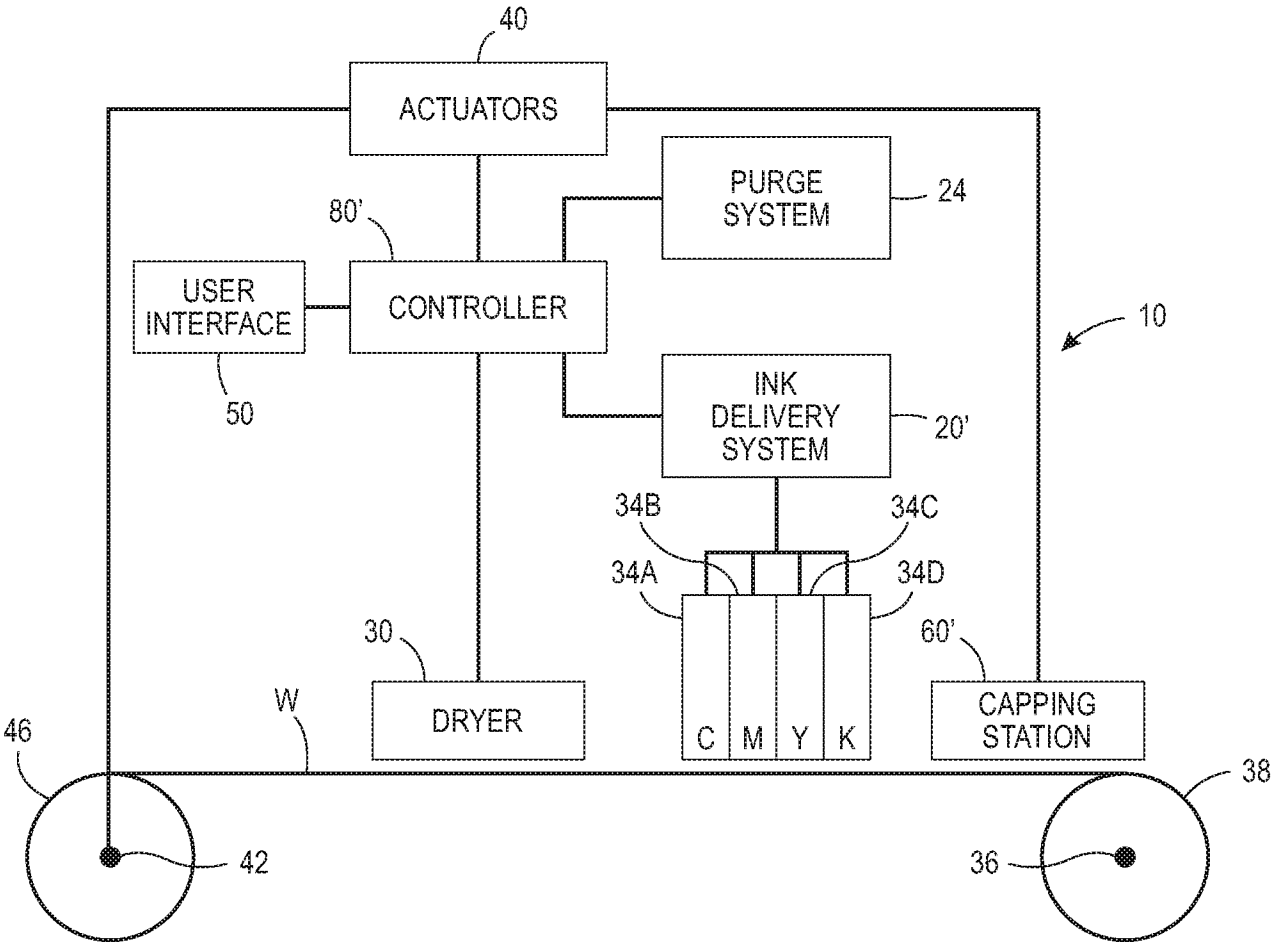
FIG. 1 is a schematic drawing of an aqueous inkjet printer that prints images on a media web and preserves the operational status of inkjets in the printheads of the printer during periods of inactivity.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for operating inkjets in an inkjet printer to reduce evaporation of ink at the nozzles of the inkjets in the printer. The reader should also appreciate that the principles set forth in this description are applicable to similar imaging devices that generate images with pixels of marking material.

FIG. 1 illustrates a high-speed aqueous ink image producing machine or printer 10 in which a controller 80' has been configured to perform the process 400 described below to operate the capping system 60' so the ink at the nozzles of the printheads 34A, 34B, 34C, and 34D maintain a low viscosity state during periods of inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

Figure 6A:
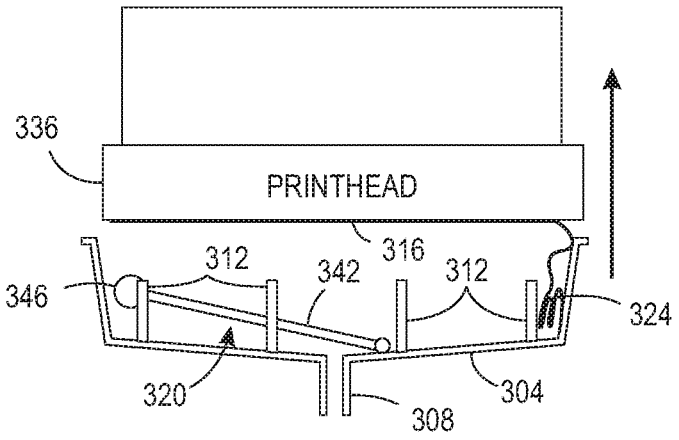
FIG. 6A and FIG. 6B are side schematic views of the printhead capping station of FIG. 2 in different phases of its removal from a printhead.
Figure 6B:
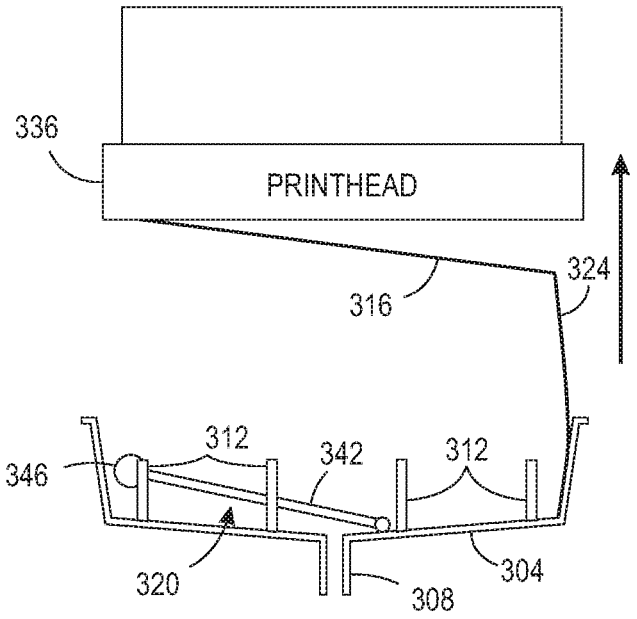
Figure 7:
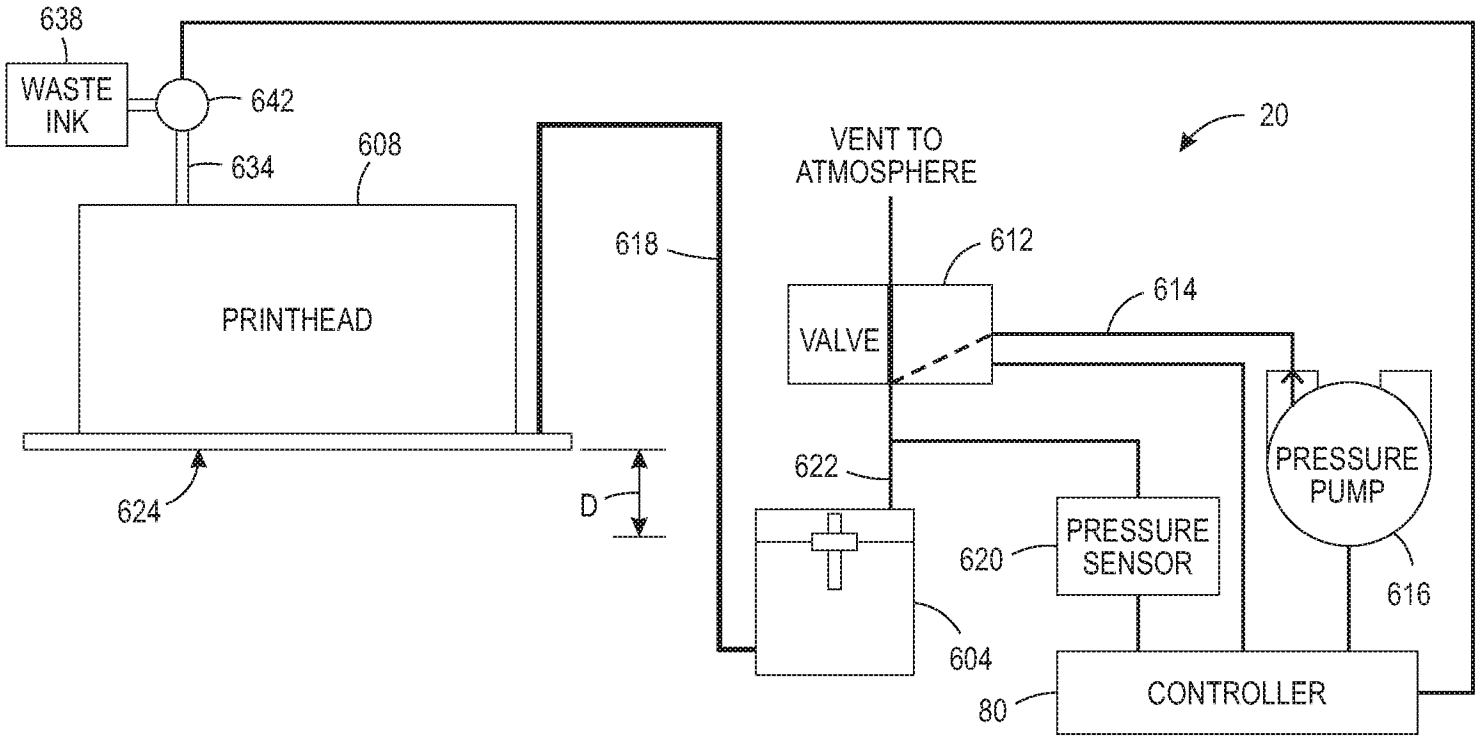
FIG. 7 PRIOR ART
FIG. 7 is a schematic diagram of a prior art ink delivery system.
Figure 8A:
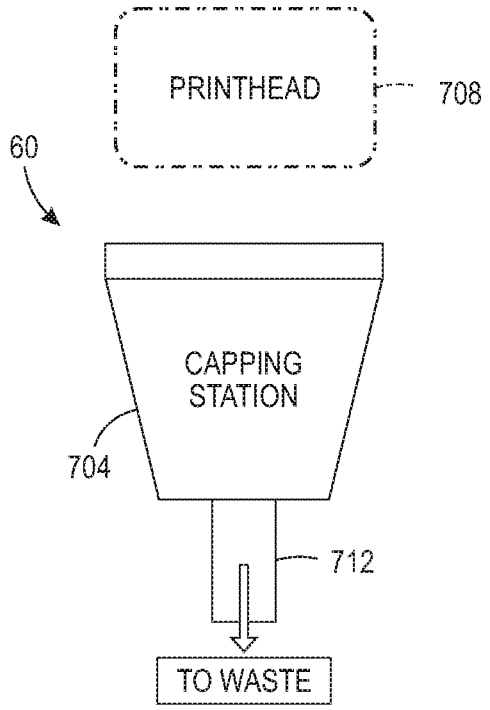
FIG. 8A PRIOR ART
FIGS. 8A and 8B are schematic diagrams of a prior art capping station.
Figure 8B:
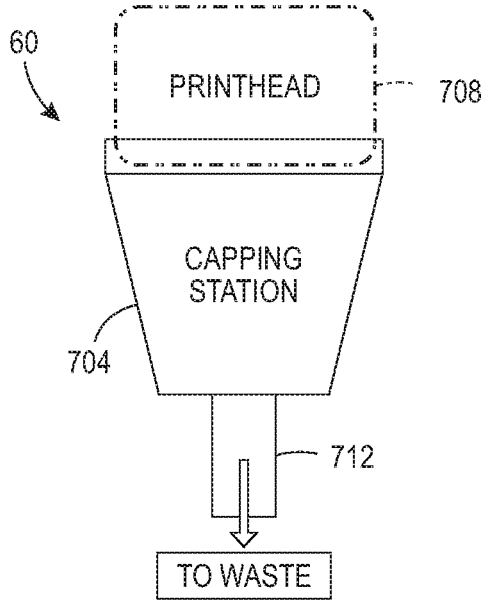
FIG. 8B PRIOR ART
Figure 9:
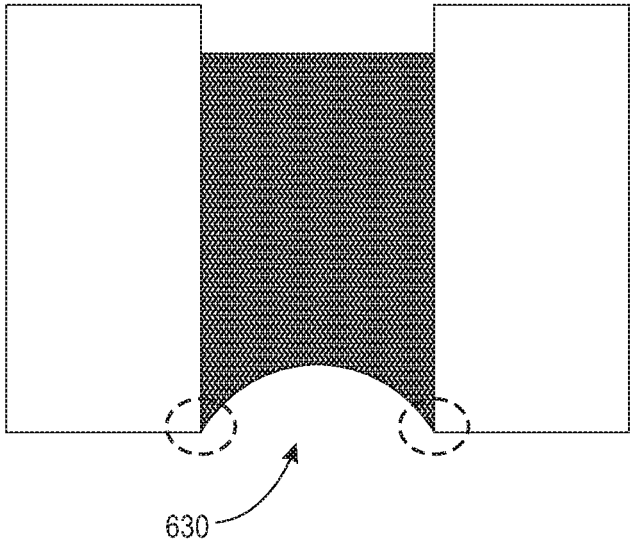
FIG. 9 PRIOR ART
FIG. 9 illustrates the ink meniscus at a nozzle of an inkjet in a prior art capping station.

The aqueous ink delivery subsystem 20, such as the one shown in FIG. 7, has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described above, to perform manifold and inkjet purges. Additionally, although not shown in FIG. 1, each printhead in a printhead module is connected to a corresponding waste ink tank with a valve as described previously with reference to FIG. 6 to enable the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module. The controller 80' also operates the capping system 60' and one or more actuators 40 that are operatively connected to components in the capping system 60' to preserve the low viscosity of the ink in the nozzles of the printheads in the printhead modules as described more fully below.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80'. The ESS or controller 80' is operably connected to the components of the ink delivery system 20', the purge system 24, the printhead modules 34A-34D (and thus the printheads), the actuators 40, the heater 30, and the capping station 60. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2:
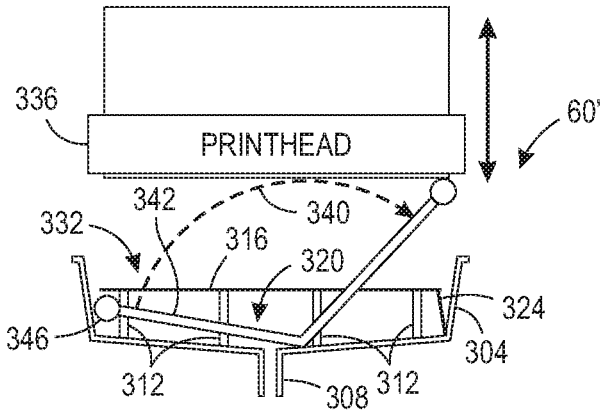
FIG. 2 is a side schematic view of a printhead capping station used in the printer of FIG. 1 to reduce the evaporation of fast drying inks from the printheads in the printers.
Figure 3A:
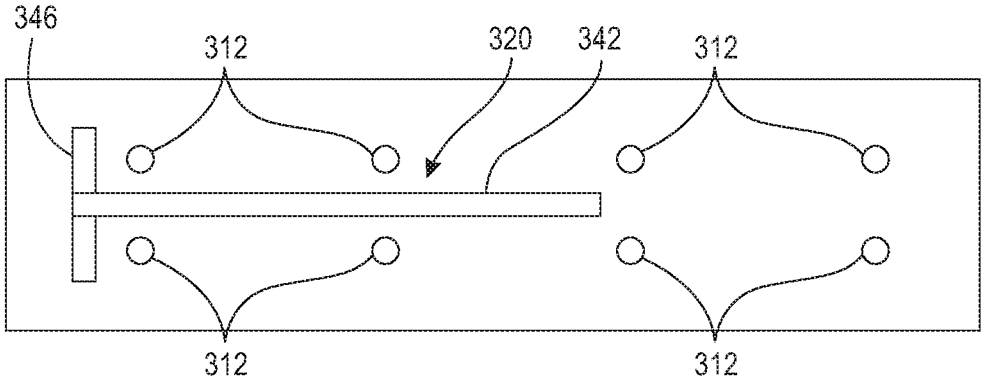
FIG. 3A is a top schematic view of the printhead capping station of FIG. 2 without the planar protector.
Figure 3B:
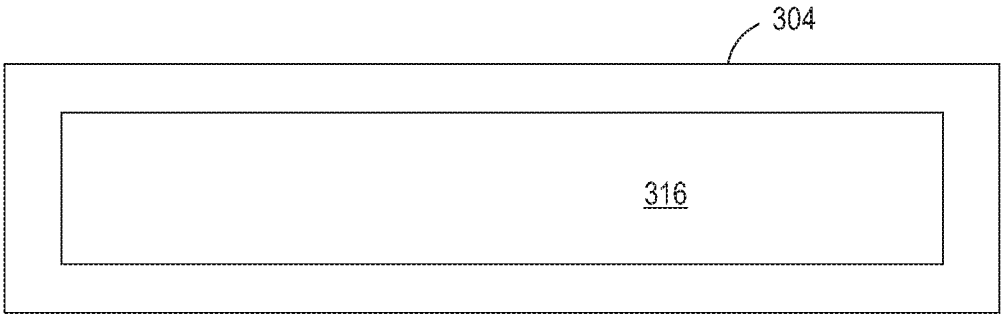
FIG. 3B is a top schematic view of the printhead capping station of FIG. 2 with the planar protector in place.

A capping station that reduces the evaporation of ink during periods of printer inactivity is shown in FIG. 2. The capping station 60' includes a printhead receptacle 304, a discharge chute 308, a plurality of standoff members 312, a planar protecting plate 316, a pivoting applicator arm 320, and a flexible member 324. The printhead receptacle 304 has one or more walls 338 that enclose a volume of air. The opening 332 is shaped to correspond to the perimeter of the printhead 336. The planar protecting plate 316 rests on the standoff members 312 that extend from a floor of the printhead receptacle 304. The pivoting applicator arm 320 is pivotably mounted to the floor of the printhead receptacle 304 so it subtends an arc from the floor of the receptacle to a position above the receptacle. As shown in FIG. 3A, the standoff members 312 are arranged in two rows on the floor of the receptacle and the support member 342 for the applicator head 346 of the applicator arm 320 is positioned between the two rows with the head 346 being positioned beyond the ends of the rows of standoff members most distal from the pivotably mounted end of the support arm 342. Although FIG. 2 depicts the applicator head 346 has a roller, a flat planar head could be used as well. The roller embodiment rotates about the longitudinal axis of the roller. In FIG. 3B, the planar protecting plate 316 rests on the standoff members 312 and covers the standoff members and the pivoting applicator arm 320.

At least the surface of the planar protecting plate 316 that does not rest on the standoff members 312 is made of hydrophilic material, which has a high surface energy, while the sides of the protecting plate that does rest on the standoff members can be made of hydrophobic material, which has a low surface energy. In other embodiments of the planar protecting plate, the planar protecting member is a single member made of hydrophilic material only. The hydrophilic material helps ensure that ink from the printhead on the planar protecting member forms a film having a uniform thickness. When the applicator arm is slowly moved to apply the film on the protecting plate to the printhead face, it squeezes the film so the air bubbles entrained in the film escape the film.

The flexible member 324 is fixedly secured at one end to the floor of the receptacle and at its other end is fixedly secured to the end of the planar protecting plate 316 that is most distal from the applicator head 346. When the planar protecting plate is resting on the standoff members 312, the flexible member 324 is slack within the receptacle 304. When the protecting plate 316 covers the printhead as shown in FIG. 6C, the flexible member is taut between the floor of the receptacle and the end of the protecting plate to which it is attached.

Figure 4:
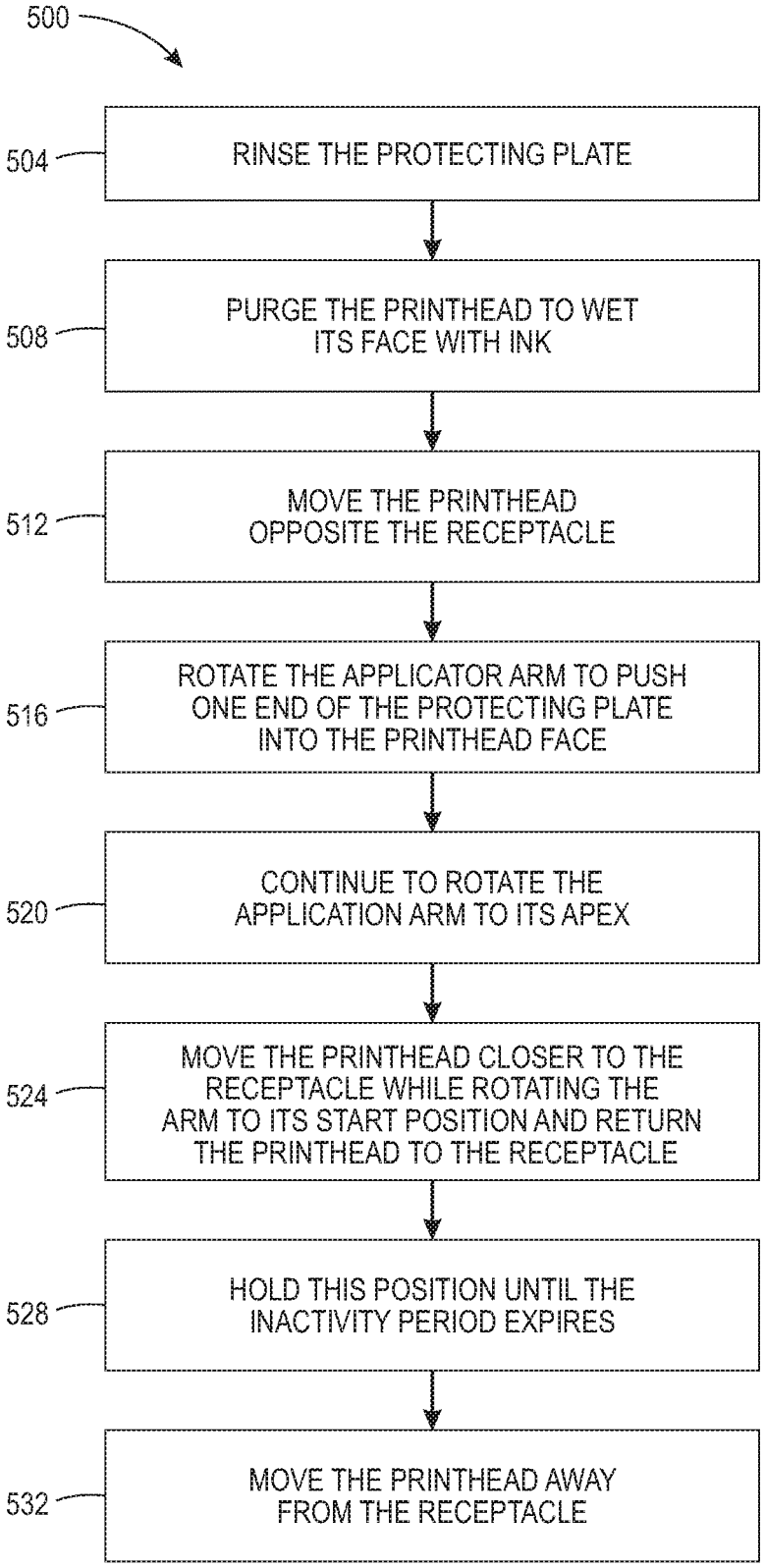
FIG. 4 is a flow diagram of a process for capping a printhead in the printer of FIG. 1 to preserve the operational status of the printheads in the printer.

FIG. 4 depicts a flow diagram for a process 500 that operates the capping station 60' to prepare the protecting plate 316 for engaging the printhead during storage of the printhead during a period of inactivity. In the discussion below, a reference to the process 500 performing a function or action refers to the operation of a controller, such as controller 80', to execute stored program instructions to perform the function or action in association with other components in the printer. The process 500 is described as being performed for a capping station in the printer 10 of FIG. 1 for illustrative purposes.

Figure 5A:
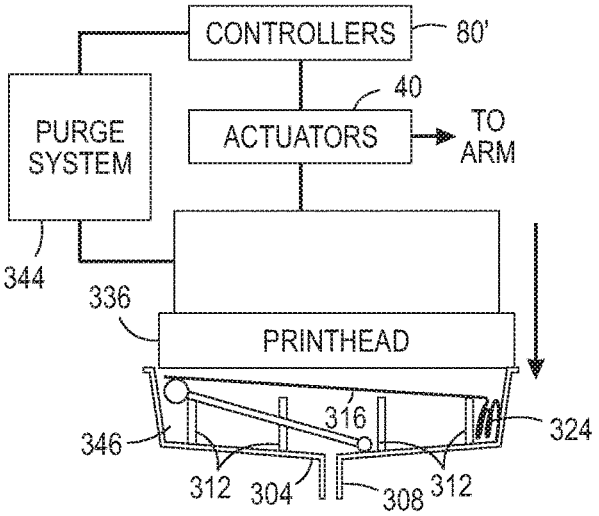
FIGS. 5A, 5B, and 5C illustrate the operation of the capping station during the process of FIG. 4.
Figure 5B:
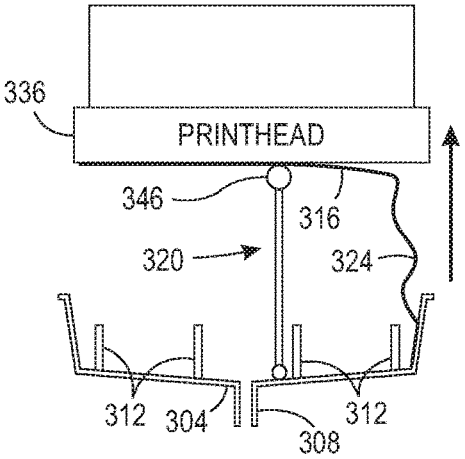
Figure 5C:
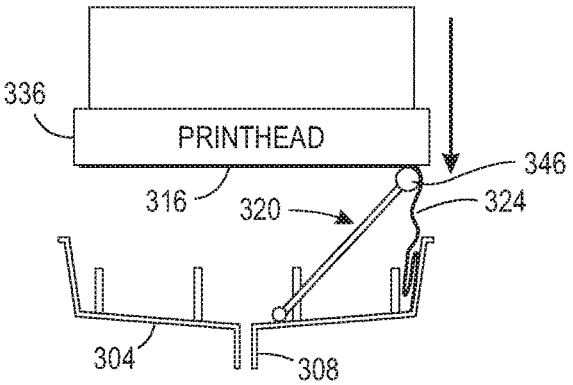

The process 500 of operating the capping station 60' is depicted in FIG. 4 and the operation of the station is illustrated in FIGS. 5A, 5B, 5C, 6A, and 6B. When the printhead is to be capped for a relatively long period of printer inactivity, the shim is rinsed with water or an ink flushing fluid (block 504). The controller 80' also operates a known pressurizing system to perform a printhead purge with enough pressure to push ink onto the face of the printhead without the ink dripping off the faceplate (block 508). The controller 80' then operates one of the actuators 40 to move the printhead proximate the receptacle (block 512) and also operates another one of the actuators 40 to rotate the applicator arm about its pivot point so the applicator head pushes the end of the protecting plate opposite the applicator head into engagement with the printhead face (block 516). This action achieves the position of the applicator arm and protecting plate on the printhead face shown in FIG. 5A. The controller then continues to operate one of the actuators to pull the printhead away from the receptacle and it also operates one of the actuators to continue the pivoting of the applicator arm 320 until the printhead and the applicator arm reach the position shown in FIG. 5B (block 520). At this position, the applicator arm 320 is at the apex of its arcuate path and the protecting plate has been applied to a first portion of the printhead face but remains separated from the remainder of the printhead face. Thereafter, the controller operates the two actuators to move the printhead toward the receptacle slightly as the applicator arm continues to pivot to finish pushing the last portion of the length of the protecting plate into engagement with the printhead face as shown in FIG. 5C. At this position, the flexible member has slack in it so the controller can operate the actuators 40 to move the printhead and the applicator arm to the position of FIG. 5B so the arm can continue its rotation and return to its start position without the flexible member becoming taut and pulling the protecting plate from the printhead face. The printhead is then lowered into the receptacle 304 (block 524). At this position, most of the length of the flexible member 324 is within the receptacle. The capping station 60' remains at the position shown in FIG. 5C to enable the ink at the nozzles of a printhead to remain immersed with liquid ink on the planar protecting plate so the ink in the nozzles does not evaporate or significantly change in viscosity. Thus, the printhead is not likely to need purging after its period of printer inactivity and ink is saved for printing.

To return the printhead to operation, the process 500 continues with the controller 80' operating the actuator connected to the printhead to move it away from the receptacle (block 528). This movement causes the flexible member 324 to reach its limit and exert a pull on the end of the protecting plate connected to it when the printhead reaches a height that exceeds that shown in FIG. 5B. As the printhead continues to move away from the receptacle, the force becomes sufficient to overcome the adhesion between the protecting plate and the printhead face and the end of the plate connected to the flexible member falls away from the printhead face. As the printhead continues to move away from the receptacle, the remaining section of the protecting plate falls from the printhead face under the effect of gravity and lands on the standoff members. This operation is shown in FIGS. 6A and 6B. The capping station remains in this position until the next period of printhead inactivity.

A printer, such as printer 10, can be configured with a capping station 60' for each printhead in each printhead module 34A, 34B, 34C, and 34D. The controller 80' can be operatively connected to the actuators in each capping station and the controller 80' is configured to operate the actuators to perform the process shown in FIG. 4 for the storage of the printheads in the printer. In this manner, all of the printheads in the printer can be stored for periods of inactivity without substantial risk of ink drying in the inkjets of the printheads. In another embodiment, the protecting plate can be connected to a reciprocating member that is operatively connected to an actuator so a controller can operate the actuator to urge the protecting plate into engagement with the printhead face and then reversed to retract the protecting plate from the printhead face.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A capping station useful for storing printheads during periods of inactivity comprising:

a printhead receptacle having at least one wall configured to enclose a volume, the printhead receptacle having an opening corresponding to a perimeter of a printhead;

a planar member configured to move between a first position at which the planar member is located within the printhead receptacle and a second position at which the planar member is external of the printhead receptacle;

a first actuator operatively connected to the planar member, the first actuator being configured to move the planar member from the first position to the second position;

a plurality of members extending from a floor of the printhead receptacle so the planar member rests on the plurality of members at the first position; and a controller operatively connected to the first actuator, the controller being configured to operate the first actuator to move the planar member from the first position to the second position to mate the planar member with a face of a printhead.

2. The capping station of claim 1 wherein the planar member has a surface made of hydrophilic material that mates with the face of the printhead.

3. The capping station of claim 2 further comprising:

an arm pivotably mounted at one end to the floor of the printhead receptacle;

an applicator mounted to another end of the arm; and the first actuator is operatively connected to the pivotably mounted arm to pivot the arm about the one end of the arm and move the planar member from the first position to the second position.

4. The capping station of claim 3 wherein the applicator is a roller.

5. The capping station of claim 4 further comprising:

a flexible member having a first end and a second end, the first end of the flexible member being fixedly mounted to the printhead receptacle and the second end of the flexible member being fixedly mounted to a surface of the planar member that does not engage the printhead and at an end of the planar member that is closest to the one end of the arm pivotably mounted to the floor when the planar member is at the first position.

6. The capping station of claim 5 further comprising:

a second actuator operatively connected to a printhead; and the controller is operatively connected to the second actuator, the controller being further configured to operate the second actuator to move the printhead toward and away from the printhead receptacle.

7. The capping station of claim 6, the controller being further configured to operate the printhead to emit ink onto the face of the printhead before the face of the printhead mates with the planar member.

8. The capping station of claim 7, the controller being further configured to operate the first actuator to move the arm at a speed that squeezes air bubbles entrained in the ink ejected onto the planar member as the planar member mates with the printhead.

9. The capping station of claim 8, the controller being further configured to operate the second actuator to move the printhead away from the planar member when the planar member is at the second position so the flexible member is pulled taut and separates the planar member from the printhead face as the printhead moves away from the planar member.

10. The capping station of claim 9 wherein the applicator is a flat planar head.

11. A printer comprising:

a plurality of printheads;

a capping station for each printhead in the plurality of printheads, each capping station including:

a printhead receptacle having at least one wall configured to enclose a volume, the printhead receptacle having an opening corresponding to a perimeter of a printhead;

a planar member configured to move between a first position at which the planar member is located within the printhead receptacle and a second position at which the planar member is external of the printhead receptacle;

a first actuator operatively connected to the planar member, the first actuator being configured to move the planar member from the first position to the second position;

a second actuator operatively connected to a printhead; and a controller operatively connected to the first actuator and the second actuator, the controller being configured to operate the first actuator to move the planar member from the first position to the second position to mate the planar member with a face of a printhead and to operate the second actuator to move the printhead toward and away from the printhead receptacle.

12. The printer of claim 11, the capping station further comprising:

a plurality of members extending from a floor of the printhead receptacle so the planar member rests on the plurality of members at the first position;

an arm pivotably mounted at one end to the floor of the printhead receptacle;

an applicator mounted to another end of the arm; and the first actuator is operatively connected to the pivotably mounted arm to pivot the arm about the one end of the arm and move the planar member from the first position to the second position.

13. The printer of claim 12, the capping station further comprising:

a flexible member having a first end and a second end, the first end of the flexible member being fixedly mounted to the printhead receptacle and the second end of the flexible member being fixedly mounted to a surface of the planar member that does not engage the printhead and at an end of the planar member that is closest to the one end of the arm pivotably mounted to the floor when the planar member is at the first position.

14. The printer of claim 13, the controller being further configured to operate the second actuator to move the printhead away from the planar member when the planar member is at the second position so the flexible member is pulled taut and separates the planar member from the printhead face as the printhead moves away from the planar member.

* * * * *